US006099108A

United States Patent [19]

Weber et al.

[11] Patent Number: 6,099,108

[45] Date of Patent: Aug. 8, 2000

[54] METHOD AND APPARATUS FOR IMPROVED INK-DROP DISTRIBUTION IN INK-JET PRINTING

[75] Inventors: Timothy L. Weber, Corvallis; John Paul Harmon, Albany; S. Dana Seccombe, Foster City; Colin C. Davis, Corvallis; Paul J. McClellan, Salem; David J. Waller, Corvallis, all of Oreg.

[73] Assignee: Hewlett-Packard Company, Palo Alto, Calif.

[21] Appl. No.: 08/812,385

[22] Filed: Mar. 5, 1997

[51] Int. Cl.[7] ..... B41J 2/21; B41J 2/145; B41J 2/15

[52] U.S. Cl. ..... 347/43; 347/40

[58] Field of Search ..... 347/41, 43, 15, 347/10, 40; 395/108

[56] References Cited

U.S. PATENT DOCUMENTS

| | | | |
|---|---|---|---|
| 4,396,924 | 8/1983 | Rosenstock | 347/40 |
| 4,468,679 | 8/1984 | Suga et al. | 347/10 |
| 4,550,326 | 10/1985 | Allen et al. | 347/44 |
| 4,621,273 | 11/1986 | Anderson | 347/40 |
| 4,631,548 | 12/1986 | Milbrandt | 347/43 |
| 4,914,451 | 4/1990 | Morris et al. | 347/105 |
| 4,967,203 | 10/1990 | Doan et al. | 347/41 |
| 4,967,208 | 10/1990 | Childers | 347/41 |
| 4,999,646 | 3/1991 | Trask | 347/41 |
| 5,196,056 | 3/1993 | Prasad | 106/15.05 |
| 5,422,666 | 6/1995 | Koyama | 347/41 |
| 5,485,180 | 1/1996 | Askeland et al. | 347/15 |
| 5,583,550 | 12/1996 | Hickman et al. | 347/41 |
| 5,731,827 | 3/1998 | Mantell et al. | 347/40 |
| 5,764,256 | 6/1998 | Zhang | 347/71 |

FOREIGN PATENT DOCUMENTS 0767061 4/1997 European Pat. Off. .

OTHER PUBLICATIONS

"Bubble Ink–Jet Technology With Improved Performance", Enrico Manini, Olivetti, Ivrea, Italy Article, Chapter 4, Thermal Ink Jet, pp. 177–178. Oct. 30–Nov. 4, 1994.

Output Hardcopy Devices, Chapter 13, by: W.J. Lloyd and H. T. Taub, (Ed. R.C. Durbeck and S. Sherr, Academic Press, San Diego, 1988).

*Primary Examiner*—N. Le
*Assistant Examiner*—Thinh Nguyen

[57] ABSTRACT

A method and apparatus for improving ink-jet print quality uses a print head having an array using a plurality of nozzles in sets in each drop generator mechanism. Where a conventional ink-jet pen fires a single droplet of ink at a pixel per firing cycle, the present invention fires a plurality of droplets at different subdivisions of pixels. The particular array design may vary from ink-to-ink or pen-to-pen. Each drop generator of a print head array includes a plurality of nozzles wherein each of the nozzles has an exit orifice with an areal dimension, and produces an ink droplet that produces a dot on adjacent print media wherein the dot has an areal dimension, less than the areal dimension of a pixel to be printed. Dots are printed in a pattern for each pixel wherein print quality is achieved that approximates a higher resolution print made by conventional ink-jet methodologies.

38 Claims, 11 Drawing Sheets

(1 of 11 Drawing Sheet(s) Filed in Color)

10x magnification
FIG. 10A 300 dpi placement (prior art)
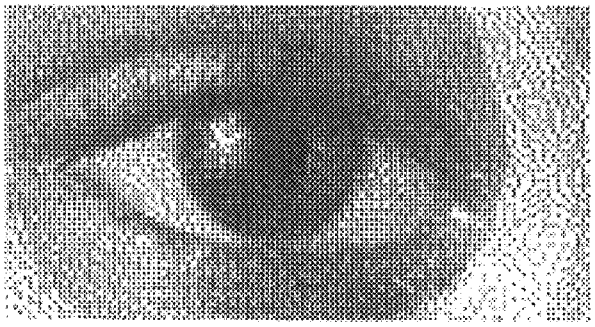
FIG. 10B 600 dpi placement (prior art)
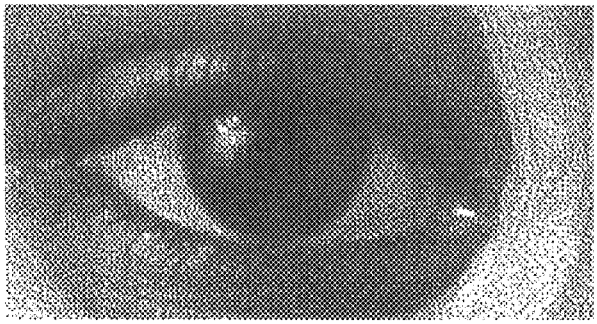
FIG. 10C CMYK R-RotQuad 300 dpi placement
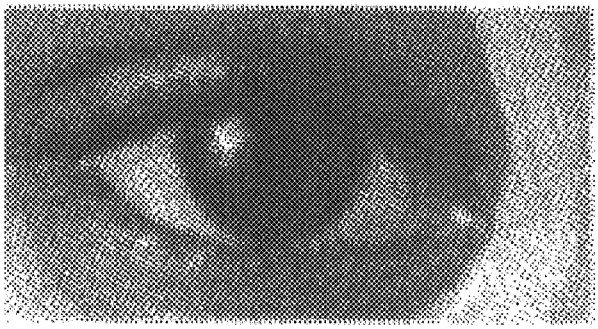
FIG. 10D C L-, MYK R-RotQuad 300 dpi placement
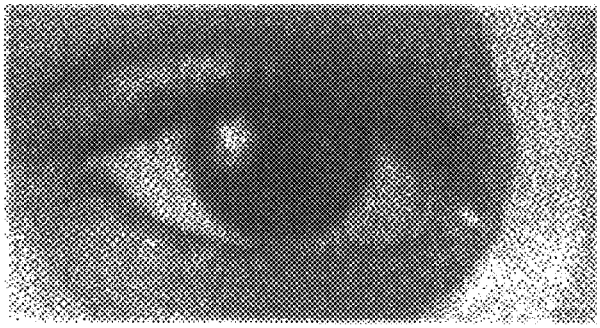

METHOD AND APPARATUS FOR IMPROVED INK-DROP DISTRIBUTION IN INK-JET PRINTING

BACKGROUND OF THE INVENTION

1. Field of the Invention

The present invention relates generally to methods and apparatus for reproducing images and alphanumeric characters, more particularly to ink-jet hard copy apparatus and, more specifically to a thermal ink-jet, multi-orifice drop generator, print head construct and its method of operation.

2. Description of Related Art

The art of ink-jet hard copy technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy Devices,* chapter 13 (Ed. R. C. Durbeck and S. Sherr, Academic Press, San Diego, 1988).

It has been estimated that the human visual system can distinguish ten million colors. Printing systems use a small subset of colors, yet can create acceptable reproductions of original images. Generally speaking, this is achieved by mixing the primary colors (red, blue green—additive; or cyan, magenta, yellow—subtractive) in sufficiently small quanta and exploiting tristimulus response idiosyncrasies of the human visual system. Effective use of these small quanta can be achieved in dot matrix color printing by varying the density or area fill, or both, to recreate each color or a reasonable semblance thereof in the image.

The quality of a printed image has many aspects. When the printed matter is an image that is a reproduction of an original image (that is to say, a photograph or graphic design rather than merely text printing), the goal of an imaging system is to accurately reproduce the appearance of the original. To achieve this goal, the system must accurately reproduce both the perceived colors (hues) and the perceived relative luminance ratios (tones) of the original. Human visual perception quickly adjusts to wide variations in luminance levels, from dark shadows to bright highlights. Between these extremes, perception tends toward an expectation of smooth transitions in luminance. However, imaging systems have yet to achieve complete faithful reproduction of the full dynamic range and perception continuity of the human visual system. While the goal is to achieve true photographic image quality reproduction, imaging systems' dynamic range printing capabilities are limited by the sensitivity and saturation level limitations inherent to the recording mechanism. The effective dynamic range can be extended somewhat by utilizing a non-linear conversion that allows some shadow and highlight detail to remain.

In ink-jet technology, which uses dot matrix manipulation to form both images and alphanumeric characters, the colors and tone of a printed image are modulated by the presence or absence of drops of ink deposited on the print medium at each target picture element (known as "pixels") of a superimposed rectangular grid overlay of the image. The luminance continuity—tonal transitions within the recorded image—is especially affected by the inherent quantization effects of using ink droplets and dot matrix imaging. These effects can appear as contouring in printed images where the original image had smooth transitions. Moreover the imaging system can introduce random or systematic luminance fluctuations (graininess—the visual recognition of individual dots with the naked eye).

Perceived quantization effects which detract from print quality can be reduced by decreasing the physical quantization levels in the imaging system and by utilizing techniques that exploit the psycho-physical characteristics of the human visual system to minimize the human perception of the quantization effects. It has been estimated that the unaided human visual system will perceive individual dots until they have been reduced to less than or equal to approximately twenty to twenty-five microns in diameter in the printed image. Therefore, undesirable quantization effects of the dot matrix printing method are reduced in the current state of the art by decreasing the size of each drop and printing at a high resolution; that is, a 1200 dots per inch ("dpi") printed image looks better to the eye than a 600 dpi image which in turn improves upon 300 dpi, etc. Additionally, undesired quantization effect can be reduced by utilizing more pen colors with varying densities of color (e.g., two cyan ink print cartridges, each containing a different dye load (the ratio of dye to solvent in the chemical composition of the ink) or containing different types of chemical colorants, dye-based or pigment-based).

To reduce quantization effects, print quality also can be enhanced by methods of saturating each pixel with large volumes of dye by using large drops, a high dye-load ink formula, or by firing multiple drops of the same color or color formulation at each pixel. Such methods are discussed in U.S. Pat. No. 4,967,203 (Doan) for an *Interlace Printing Process,* U.S. Pat. No. 4,999,646 (Trask) for a *Method for Enhancing the Uniformity and Consistency of Dot Formation Produced by Color Ink Jet Printing,* and U.S. Pat. No. 5,583,550 (Hickman) for *Ink Drop Placement for Improved Imaging* (each assigned to the common assignee of the present invention). However, large drops create large dots, or larger groups of dots known as "superpixels," which are quite visible in transition zones. Moreover, each of these methods consume ink at a rapid rate and are thus more expensive to operate. Drop volume control and multi-drop methods of inking are taught respectively by Childers in U.S. Pat. No. 4,967,208 for an *Offset Nozzle Droplet Formation* and U.S. Pat. No. 5,485,180 (Askeland et al.) for *Inking for Color-Inkjet Printers, Using Non-Integral Drop Averages, Media Varying Inking,* or *More Than Two Drops Per Pixel* (each assigned to the common assignee of the present invention). In a multi-drop mode, the resulting dot will vary in size or in color depending on the number of drops fired at an individual pixel or superpixel and the constitution of the ink with respect to its spreading characteristics after impact on the particular medium being printed (plain paper, glossy paper, transparency, etc.). The luminance and color of the printed image is modulated by manipulating the size and densities of drops of each color at each target pixel. The quantization effects of this mode can be physically reduced in the same ways as for the single-drop per pixel mode. The quantization levels can also be reduced at the same printing resolution by increasing the number of drops that can be fired at one time from each nozzle in a print head array and either adjusting the density of the ink or the size of each drop fired so as to achieve full dot density. However, simultaneously decreasing drop size and increasing the printing resolution, or increasing the number of pens and varieties of inks employed in a hard copy apparatus is very expensive, so ink-jet hard copy apparatus designed specifically for imaging art reproduction generally use multi-drop modes to improve color saturation.

When the size of the printed dots is modulated the image quality is very dependent on dot placement accuracy and resolution. Misplaced dots leave unmarked pixels which appear as white dots or even bands of white lines within or between print swaths (known as "banding"). Mechanical tolerances are critical in the construction as the print head geometries of the nozzles are reduced in order to achieve a resolution of 600 dpi or greater. Therefore, the cost of manufacture increases with the increase of the resolution design specification. Furthermore, as the number of drops fired at one time by multiplexing nozzles increases, the minimum nozzle drop volume decreases, dot placement precision requirements increase, and thermal efficiency of the print head becomes more difficult to control. High temperatures not only bum out print head elements faster but also have to be taken into account when formulating the inks to be used.

When the density of the printed dots is modulated, the low dye load inks require that more ink be placed on the print media, resulting in less efficient ink usage and higher risk of ink coalescence and smearing. Ink usage efficiency decreases and risk of coalescence and smearing increases with the number of drops fired at one time from each nozzle of the print head array.

Another methodology for controlling print quality is to focus on the properties of the ink itself. When an ink drop contacts the print media, lateral diffusion ("spreading") begins, eventually ceasing as the colorant vehicle (water or some other solvent) of the ink is sufficiently spread and evaporates. For example, in U.S. Pat. No. 4,914,451 (Morris et al., assigned to the common assignee of the present invention), *Post-Printing Image Development of Ink-Jet Generated Transparencies,* lateral spreading of each droplet is controlled with media coatings that control latent lateral diffusion of the printed ink dots. However, this increases the cost of the print media. Lateral spreading also causes adjacent droplets to bleed into each other. The ink composition itself can be constituted to reduce bleed, such as taught by Prasad in U.S. Pat. No. 5,196,056 for an *Ink Jet Composition with Reduced Bleed.* However, this may result in a formulation not suitable for the spectrum of available print media that end users may find desirous.

One apparatus for improving print quality is discussed in a very short article, *Bubble Ink-Jet Technology with Improved Performance,* by Enrico Manini, Olivetti, presented at IS&T's Tenth International Congress on Advances in Non-Impact Printing Technologies, Oct. 30–Nov. 4, 1994, New Orleans, La. Manini shows a concept for, "better distributing the ink on the paper, by using more, smaller droplets . . . utilizing several nozzles for each pressure chamber, so that a fine shower of ink is deposited on the paper." Sketches are provided by Manini showing two-nozzle pressure chambers, three-nozzle chambers, and four-nozzle chambers. Manini shows the deposition of multiple drops of ink within a pixel areal dimension such that individual drops are in adjacent contact or overlapping. Manini alleges the devices abilities: to make a square elementary dot to thereby provide a 15% ink savings and faster drying time; to create better linearity in gray scaling; and to allow the use of smaller nozzles which allow higher capillary refill (meaning a faster throughput capability generally measured in printed pages per minute, "ppm"). No working embodiment is disclosed and Manini himself admits, "The hydraulic tuning between the entrance duct and the outlet nozzles is however rather complex and requires a lot of experimentation."

Manini, however, only followed along the path of prior U.S. Pat. No. 4,621,273, filed on Dec. 16, 1982, teaching a *Print Head for Printing or Vector Plotting with a Multiplicity of Line Widths* (Anderson; assigned to the common assignee herein). Anderson shows a multi-nozzle arrangement (a "primitive") for an 80–100 dpi raster/vector plotter with ink jet nozzles at selected points of a two-dimensional grid. However, while Anderson teaches a variety of useful primitive patterns (see e.g., FIGS. 1A–2B therein), the dot pattern is specifically limited to having only one nozzle on any given column in the grid by having only one nozzle in any given row or column. Selective firing is then directed depending on the plot to be created. A heavy interlacing of dots is required as demonstrated in FIGS. 4 and 5 therein.

Another problem with thermal ink-jet print heads is the phenomenon known as "puddling." An ink drop exiting an orifice will tend to leave behind minute amounts of ink on the nozzle plate surface about each orifice. As these puddles and an exiting ink drop will tend to attract the tail of the drop and change its trajectory. A change in trajectory means the drop will not hit its targeted pixel center, introducing printing errors on the media. Tuning of nozzle plates is proposed by Allen et al. in U.S. Pat. No. 4,550,326 for *Fluidic Tuning of Impulse Jet Devices Using Passive Orifices* (assigned to the common assignee herein).

Another problem in ink-jet printing occurs at higher resolutions, for example, in multi-pass and bidirectional 300 dpi printing. Misaligned drops cause adverse consequences such as graininess, hue shift, white spaces, and the like. Normally, binary drops are deposited on the grid of square pixels such that drops overlap to a degree necessary to ensure no visible white spaces occur at the four corners of the target pixel (as taught by Trask, Doan, and Hickman, supra). As mentioned, ink usage is dramatically increased by these techniques. Moreover, print media line feed error is significant compared to drop size and, without multiple-drop or overlap between pixels, white banding between swaths occurs. Thus, each of these prior art inventions are using more ink than would be required if perfectly accurate trajectories of perfectly sized ink drops could be achieved.

Therefore, until a technological breakthrough to achieve such perfection is attained, there is still a need for improvement in thermal ink-jet print heads and methods of distribution of ink drops to achieve superior print quality, decreasing quantization effects and ink usage. The goal is to reduce the required luminance and color quantization levels of an ink-jet printing system for high fidelity without requiring higher dot placement printing resolution while also increasing data throughput.

SUMMARY OF THE INVENTION

In its basic aspects, the present invention provides an print head device for use in printing a pixel dot matrix on a print medium. The print head device includes: an array of drop generators, each of the drop generators having a plurality of nozzles; and the plurality of nozzles is configured such that each drop generator includes a set of nozzles in a predetermined layout providing a set of nozzles in each of the drop generators wherein as a drop generator traverses print medium target pixels as the print head is scanned across the medium, the nozzles in each set provide a distribution of ink droplets forming dots on the medium such that at least one of the dots formed on the medium from each set is substantially outside the target pixel.

Another basic aspect of the present invention is an ink-jet pen. The pen includes: a housing; at least one on-board ink reservoir within the housing, the reservoir containing at least one supply of ink of a predetermined chemical formulation;

a print head fluidically coupled to the reservoir to receive a flow of ink therefrom; electrical contacts for connecting the print head to a hard copy apparatus print controller; the print head having a plurality of drop generators oriented in an array; each drop generator of the array having a plurality of nozzles arrayed about a geometric center point of the drop generator; each of the drop generators having at least one heating element connected to the electrical contacts; each of the nozzles having an ink entrance port proximate the heating element, the entrance port having an entrance port areal dimension; each of the nozzles having an exit orifice distal from the heating element for emitting ink drops onto an adjacently positioned print medium, the exit orifice having a predetermined exit orifice areal dimension less than an areal dimension of a pixel to be printed using the cartridge and less than the entrance orifice areal dimension and wherein the sum of the areal dimensions of the exit orifices in an array of nozzles is less than the areal dimension of a pixel.

In another basic aspect of the invention there is taught a method of distributing ink drops onto an adjacent print medium in order to form a dot matrix print on a grid of pixels wherein the dot matrix is manipulated selectively to form graphic art, images, and alphanumeric characters. The method includes the steps of:

scanning a print medium with at least one ink-jet pen in a first axial direction, X;

during the step of scanning, simultaneously generating a plurality of ink drops in each drop generator of a drop generator array of an ink-jet print head of the ink-jet pen, simultaneously firing sets of the simultaneously generated ink drops selectively at the grid of pixels such that each of the sets of ink drops form dots on the media, each of the dots having a size less than the size of a pixel, and each of the sets of ink drops being distributed in a pattern on or about a target pixel of the grid such that each of the drops of a set produces a dot having an area less than or equal to 1 divided by number-of-drops-per-set multiplied by the area of the target pixel ($area_{dot} \leqq (1/n)*P_a$, where "n" is the number of orifices per drop generator and "$P_a$" is the area of a pixel to be printed).

In yet another basic aspect the present invention provides for an ink-jet hard copy apparatus, having a housing, a scanning carriage, at least one pen mounted in the carriage, and a platen where swath printing operation is performed. The apparatus further provides for the pen having a housing; at least one on-board ink reservoir within the housing, the reservoir containing at least one supply of ink of a predetermined chemical formulation; a print head fluidically coupled to the reservoir to receive a flow of ink therefrom; electrical contacts for connecting the print head to a hard copy apparatus print controller; the print head having a plurality of drop generators oriented in an array; each drop generator of the array having a plurality of nozzles arrayed about a geometric center point of the drop generator; each of the drop generators having at least one heating element connected to the electrical contacts; and each of the nozzles having an ink entrance port proximate the heating element, the entrance port having an entrance port areal dimension, each of the nozzles having an exit orifice distal from the heating element for emitting ink drops onto an adjacently positioned print medium, the exit orifice having a predetermined exit orifice areal dimension less than the areal dimension of a pixel to be printed using the cartridge and less than the entrance orifice areal dimension and wherein the sum of the areal dimensions of the exit orifices in an array of nozzles is less than the areal dimension of a pixel, and each of the nozzles of each of the drop generators are oriented in a position rotated about a geometric center point of the drop generator with respect to an intersection of axes in a plane of a scan axis and a plane of a media motion axis such that dots are printed from each of the nozzles in adjoining pixels to a pixel each exit orifice has an exit orifice areal dimension sized to eject a droplet that will create a dot on a target media with an areal dimension less than an area which a drop generator is traversing, and each exit orifice has an exit orifice areal dimension less than or equal to an area calculated in accordance with a formula: 1 divided by the number of orifices per drop generator times the areal dimension of a pixel ($A_{eo} \leqq (1/n)*P_a$, "$A_{eo}$" is the exit orifice area, "n" is the number of orifice per drop generator, and "$P_a$" is the area of a pixel to be printed) It is an advantage of the present invention that it provides a method for lowering edge transition sharpness.

It is a further advantage of the present invention that it improves the imaging of luminance transition zones.

It is an advantage of the present invention that it achieves lower print graininess and smoother color transitions in the printing of mid-tone regions than is achieved using single orifice drop generators implementing the same dot placement resolution, without requiring increased printing resolution or number of multi-drop mode print levels.

It is an advantage of the present invention that it substantially eliminates the need for overlapping of printed dots to reduce quantization errors, deceasing the amount of ink needed to print an image.

It is an advantage of the present invention that it improves ink-jet print quality perception without increasing ink quantity per print.

It is an advantage of the present invention that it decreases graininess of an ink-jet print without reducing dye load in the ink.

It is another advantage of the present invention that it reduces the amount of water or other dye solvent deposited on the print media, thereby reducing both drying time and print media cockle effects.

It is another advantage of the present invention that nozzle dimensions are reduced, decreasing refill time (refill time is proportional to the capillarity force which is inversely proportional to exit orifice diameter) and increasing hard copy throughput proportionally.

It is another advantage of the present invention that reduced nozzle dimensions forming smaller ink drops requires less firing energy per drop from the heating element of the drop generator, improving thermal characteristics and print head life expectancy.

It is yet another advantage of the present invention that it increases life of the print head as heating element resistors are not required to fire as many times per pixel as in commercial multi-drop mode hard copy apparatus.

It is another advantage of the present invention that it improves print quality through reducing sensitivity to drop misalignment, decreasing sensitivity to trajectory errors caused by formation of puddles of ink around a nozzle's exit orifice.

It is yet another advantage of the present invention that print quality is improved while using less ink by distributing a given drop volume, e.g., of a 600 dpi drop, over the area of a larger region, e.g., four quadrants of a 300 dpi pixel area, approximately one-quarter the saturation of the full dye load, lowering the density of the page by spreading less ink more evenly over the pixels.

It is still another advantage of the present invention that a multi-nozzle drop generator can be adapted to a variety of layout configurations such that resulting dots on the print media form more diffuse pixel fill, require less ink to print, and conceal drop misalignment errors, sheet feed errors, and trajectory errors.

It is still another advantage of the present invention that graphics and images require only single inks of primary colors to produce a range of hues formerly requiring multiple inks of primary colors using different dye loads or colorant formulations.

It is a further advantage of the present invention that it increases throughput by being adaptable to employing bi-directional scan printing.

It is a further advantage of the present invention that it is adaptable to a combination of orientations of each multi-nozzle drop generator such that printing errors such as those caused by clogged nozzles or mis-firing drop generator nozzles, are masked in the print.

It is yet another advantage of the present invention that it eases the manufacturing tolerance requirement for nozzle-to-heating element alignment.

It is yet another advantage of the present invention that it can be retrofit to existing commercial ink-jet hard copy apparatus.

Other objects, features and advantages of the present invention will become apparent upon consideration of the following explanation and the accompanying drawings, in which like reference designations represent like features throughout the drawings,

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

FIGS. 10A, 10B, 10C and 10D are color comparison sample prints demonstrating print quality improvement in accordance with the use of a multi-nozzle print head constructed in accordance with the present invention.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
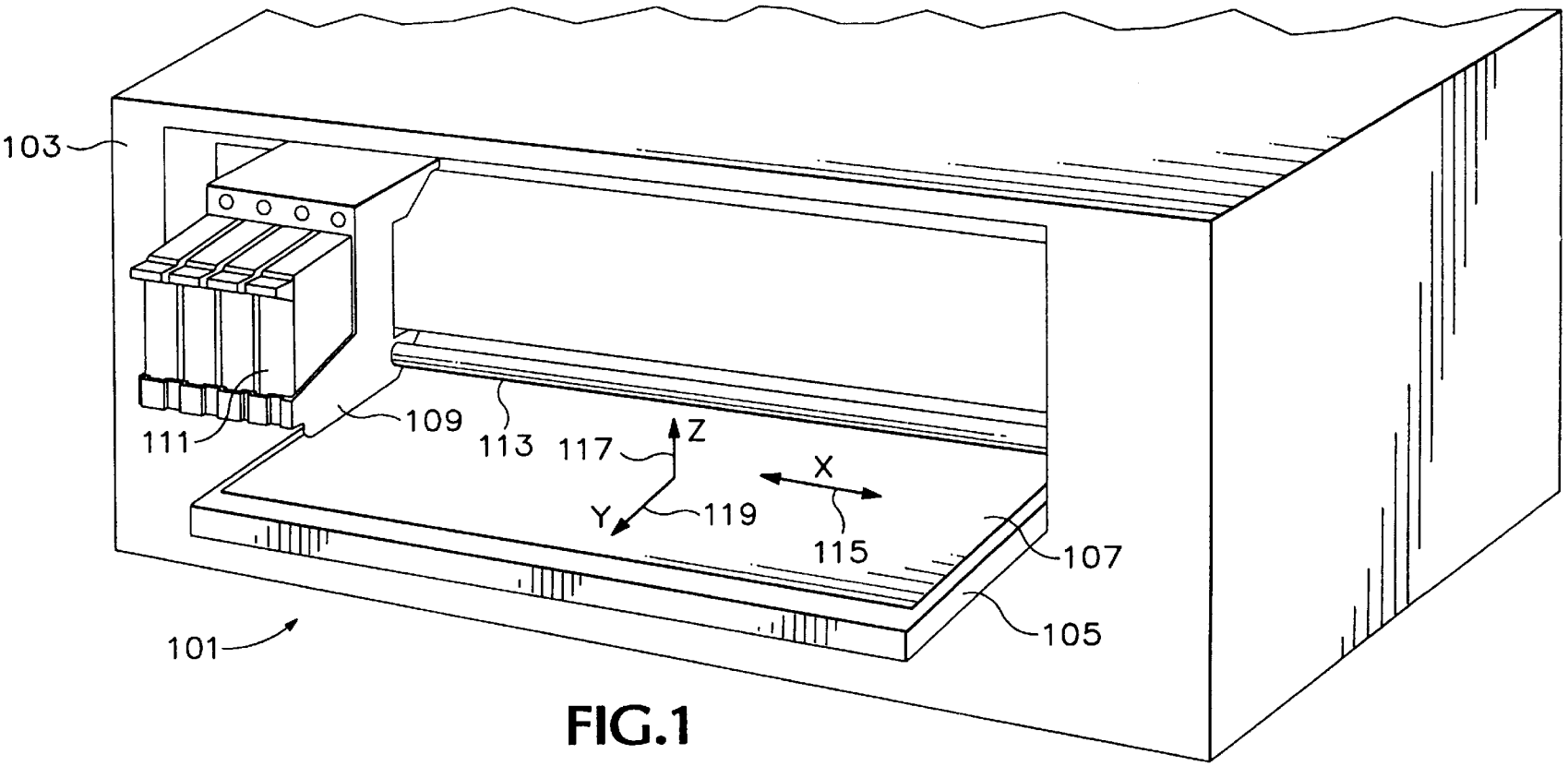
FIG. 1 is a schematic drawing in perspective view (partial cut-away) of an ink-jet apparatus (cover panel facia removed) in which the present invention is incorporated.

An exemplary ink-jet hard copy apparatus, a computer printer 101, is shown in rudimentary form in FIG. 1. A printer housing 103 contains a platen 105 to which input print media 107 is transported by mechanisms as would be known in the state of the art. A carriage 109 holds a set 111 of individual print cartridges, one having cyan ink, one having magenta ink, one having yellow ink, and one having black ink. (Alternatively, ink-jet "pens" comprise semi-permanent print head mechanisms having at least one small volume, on-board, ink chamber that is sporadically replenished from fluidically-coupled, off-axis, ink reservoirs; the present invention is applicable to both ink-jet cartridges and pens.) The carriage 109 is mounted on a slider 113, allowing the carriage 109 to be scanned back and forth across the print media 107. The scan axis, "X," is indicated by arrow 115. As the carriage 109 scans, ink drops can be fired from the set 111 of print cartridges onto the media 107 in predetermined print swath patterns, forming images or alphanumeric characters using dot matrix manipulation. Generally, the dot matrix manipulation is determined by a computer (not shown) and instructions are transmitted to an on-board, microprocessor-based, electronic controller (not shown) within the printer 101. The ink drop trajectory axis, "Z," is indicated by arrow 117. When a swath of print has been completed, the media 107 is moved an appropriate distance along the print media axis, "Y," indicated by arrow 119 and the next swath can be printed.

Figure 2:
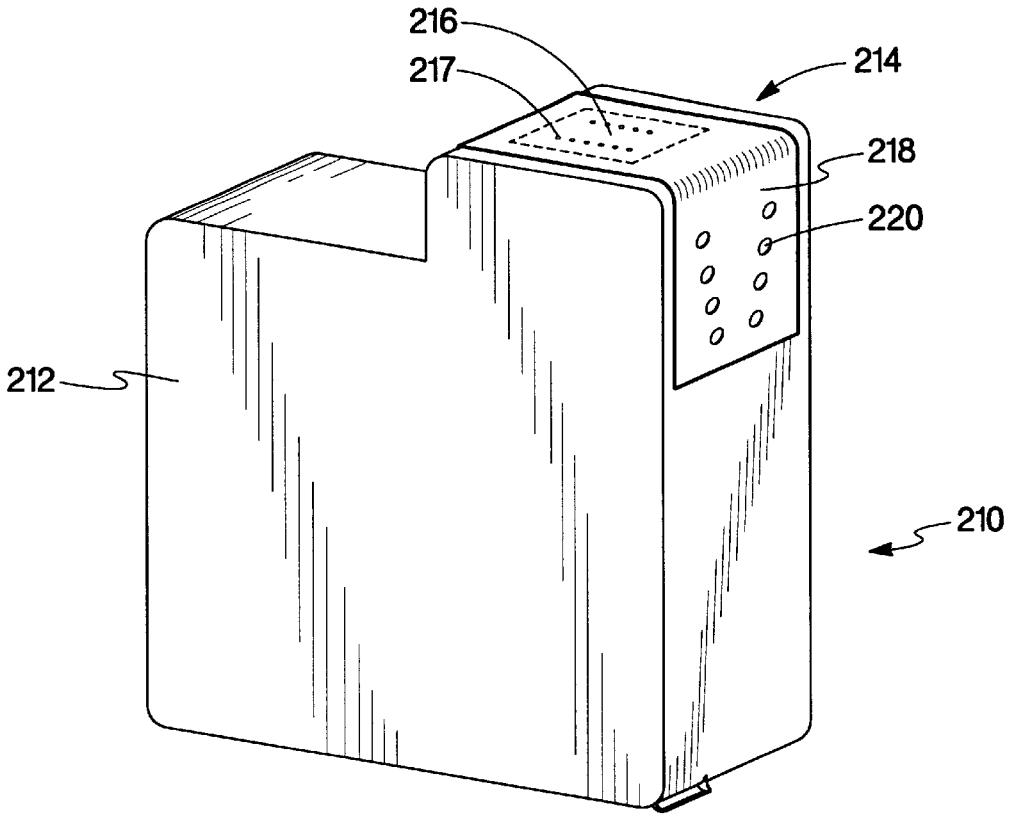
FIG. 2 is a schematic drawing in a perspective view of an ink-jet print cartridge component of FIG. 1.
Figure 2A:
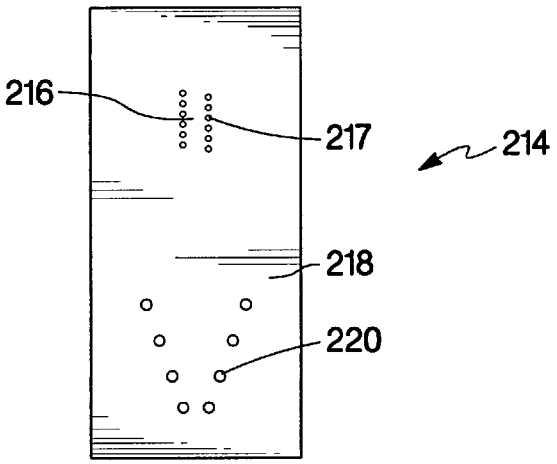
FIG. 2A is a schematic drawing of detail of a print head component of the print cartridge of FIG. 2.
Figure 3A:
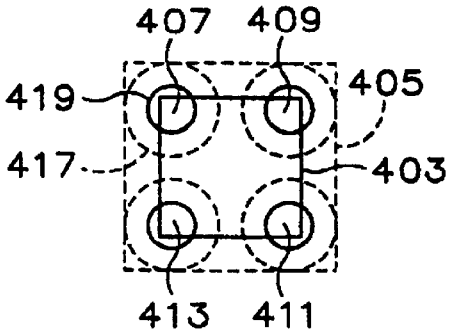
FIGS. 3A, 3B and 3C are schematic drawings (top view) of three different nozzle placement configurations relative to a central heating element of an ink-jet print head drop generator construct in accordance with the present invention.
Figure 3B:
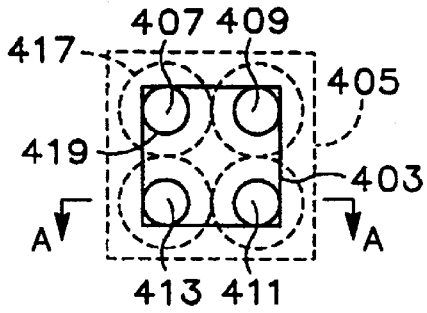
Figure 3C:
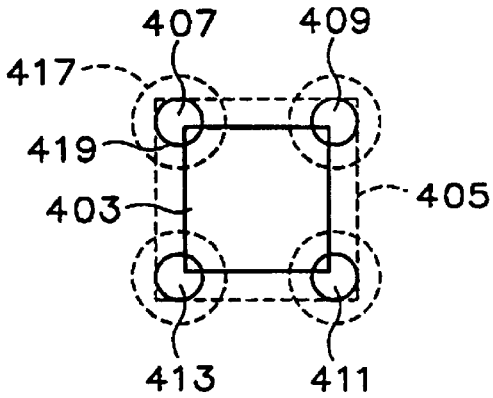

An exemplary thermal ink-jet cartridge 210 is shown in FIGS. 2 and 2A. A cartridge housing, or shell, 212 contains an internal reservoir of ink (not shown). The cartridge 210 is provided with a print head 214, which may be manufactured in the manner of a flex circuit 218, having electrical contacts 220. The print head 214 includes an orifice plate 216, having a plurality of miniature nozzles 217 constructed in combination with subjacent structures leading to respective heating elements (generally electrical resistors) that are connected to the contacts 220; together these elements form a print head array of "drop generators" (not shown; but see FIG. 4 below, and e.g., above-referenced U.S. Pat. Nos. 4,967,208 and 5,278,584; see also, U.S. Pat. Nos. 5,291,226, 5,305,015, and 5,305,018 (Schantz et al., assigned to the common assignee of the present invention and incorporated herein by reference) which teach methodologies for the manufacture of laser ablated print head components). FIG. 2A depicts a simplified commercial design having an array of nozzles 217 comprising a layout of a plurality of single nozzle drop generators arranged in two parallel columns. Thermal excitation of ink via the heating elements is used to eject ink drops through the nozzles onto an adjacent print medium (see FIG. 1, element 107). In a commercial product such as the Hewlett-Packard™ DeskJet™ printer, one hundred and ninety-two (192), single nozzle, drop generators are employed to allow 300 dpi print resolution.

Nozzle configurations, a primary aspect of the present invention, are design factors that control droplet size, velocity and trajectory of the droplets of ink in the Z axis. The standard drop generator configuration has one orifice and is fired in either a single-drop per pixel or multi-drop per pixel print mode. (In the single-drop mode (known as "binary"), one ink drop is selectively fired from each nozzle 217 from each print cartridge 210 toward a respective target pixel on the print media 107 (that is, a target pixel might get one drop of yellow from a nozzle and two drops of cyan from another nozzle to achieve a specific hue); in the multi-drop mode to improve saturation and resolution two droplets of yellow and four of cyan might be used for that particular hue. (For the purpose of this description and the claims of the present invention, a target pixel shall mean a pixel which a drop generator is traversing as an ink-jet print head is scanned across an adjacent print medium, taking into consideration the physics of firing, flight time, trajectory, nozzle configuration, and the like as would be known to a person skilled in the art; that is, in a conventional print head it is the pixel at which a particular drop generator is aiming; as will be recognized based on the following detailed description, with respect to the present invention, the target pixel may differ in location from a pixel on which the drop generator of the present invention forms dots; that is, dots may be formed in pixels other than the currently traversed pixel, i.e., other than the traditional target pixel.)) The resulting dot on the print media is approximately the same size and color as the dots from the same and other nozzles on the same print cartridge.

Comparing FIGS. 3A–C and 4A–B to FIG. 2 and 2A, it will be recognized that in a multi-nozzle drop generator design, the orifice plate can have a variety of layout configurations for each drop generator. In a commercial embodiment, each multi-nozzle drop generator now includes an array of sets of nozzles; for example to do 300 dpi printing, 192 sets of four-nozzle drop generators (768 nozzles in sets of four) is employed. Note that since the number of heating elements has not been changed from the construct depicted in FIGS. 1–2A to achieve the configurations in FIGS. 3A–3C and FIG. 4B, a retrofit using the same controller is possible.

Figure 4A:
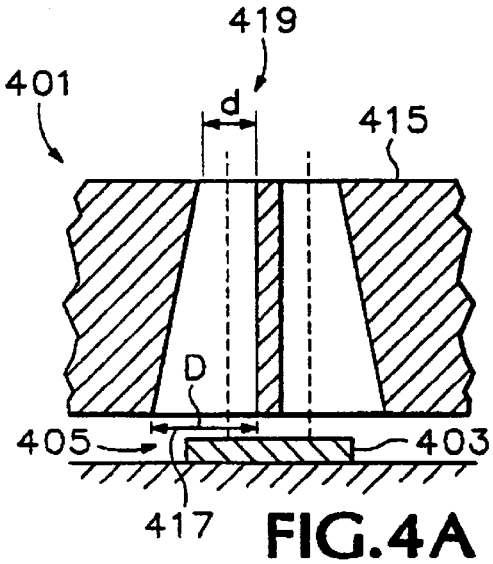
FIG. 4A is a schematic drawing in accordance with the present invention of a cross-section of an ink drop generator, taken in cross-section A—A of FIG. 3B.
Figure 4B:
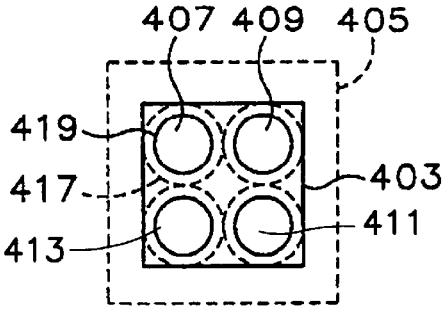
FIG. 4B is a schematic drawing (top view) in accordance with the present invention of a fourth nozzle placement configuration relative to a central heating element of a drop generator as shown in FIGS. 3A–3C.
Figure 13:
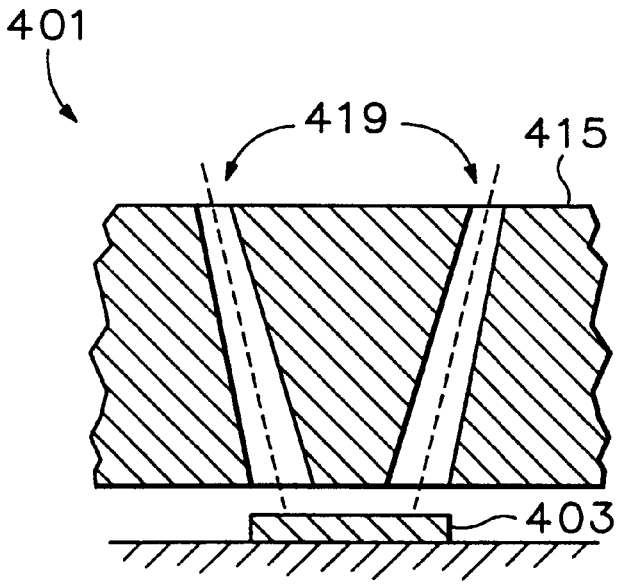
FIG. 13 is an alternative embodiment of an ink drop generator in cross-section of the present invention as shown in FIG. 4A.

In cross-section as generally depicted in FIG. 4A, taken in section A—A of FIG. 4B, a drop generator 401 is formed using, for example, known laser ablation construction (see Background section and Schantz et al. U.S. Patents, supra), having a heating element, resistor, 403, located in an ink firing chamber 405. In a top-firing (versus side-firing) embodiment, nozzles 407, 409, 411, 413, are cut through a manifold 415. Each nozzle 407, 409, 411, 413 is tapered from an ink entrance diameter, "D," 417, superjacent the heating element 403 to a distal, narrower, ink drop exit diameter, "d," 419. (In order to clearly distinguish the nozzle elements, the entrance proximate the heating element 403 is referred to as an ink "entrance port" and the distal ink exit from the nozzle from which ink droplets are expelled toward the print media is referred to as an "exit orifice".) A comparison of FIGS. 3A, 3B, 3C and 4B exemplifies that a variety of design relative configurations are possible (the examples are not intended to limit the scope of the invention to only the shown layouts as others, including both even and odd number of nozzle/orifice set arrays and combinatorial nozzle/orifice sets will be apparent to those skilled in the art). It should be kept in mind that a specific optimal layout may be dependent upon many apparatus design factors, including scan velocity, ink composition, ink droplet flight time, flight distance between the orifice plate and the media, and the like as would be known to a person skilled in the art. Moreover, in the preferred embodiment of the present invention, it is specifically intended that the droplets simultaneously fired do not merge in flight. If expedient to another design criteria, the nozzles can be oriented such that drops will merge or actually diverge in flight. Such an alternative embodiment is shown in FIG. 13.

Moreover, note that the mix of nozzles per drop generator need not be a constant throughout the array. That is, a first set for one ink may have three nozzles and another set of the array for another ink may have six nozzles per drop generator.

Each exit orifice has an exit orifice areal dimension less than: the integer 1 divided by the number of orifices per drop generator times the areal dimension of a pixel ($1/n*P_a$, where "n" is the number of orifices per drop generator and "$P_a$" is the area of a pixel to be printed) For example, if three nozzles are in a particular drop generator, each exit orifice has an area less than ⅓ times the area of a pixel, $\frac{1}{3}*(\frac{1}{300})^2$ sq. in. if four nozzles per drop generator, each exit orifice has an area less than $\frac{1}{4}*(\frac{1}{300})^2$ sq. in., etc. The sum of the areas of each nozzle array in a drop generator is therefore less than the area of a pixel. In other words, the intent is to generate ink droplets that will form dots having a diameter less than or equal to approximately twenty to twenty-five microns in a distribution pattern where the dots occupy contiguous regions of the pixels and any spaces remaining between the dots are substantially less than twenty to twenty-five microns and are therefore invisible to the naked eye.

Figure 5:
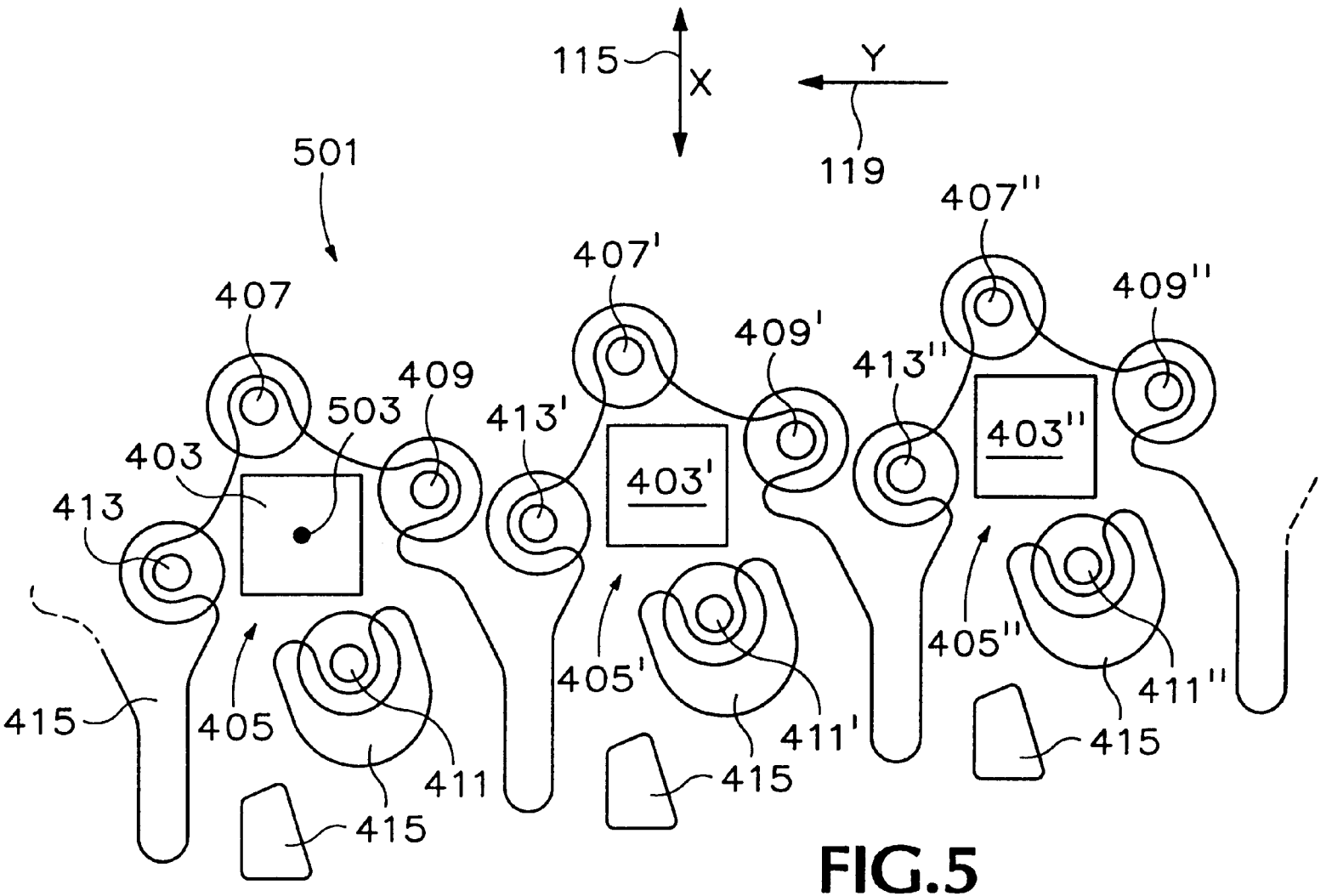
FIG. 5 is a schematic drawing (top view) of a set of three, four nozzle, one heating element, ink-jet drop generators (a portion of a full array) in accordance with a preferred embodiment of the present invention.

A first preferred embodiment of a partial orifice plate array 501 of four nozzle ink drop generators is shown in FIG. 5 (three sets of a total array), referred to hereinafter as a "right rotated quad architecture." Note that in the preceding exemplary embodiments (as in the Manini prior art), the nozzles 407, 409, 411, 413 are all oriented in quadrants orthogonally set about a geometric center point of the resistor 403 (viz., the geometric center point of the drop generator and relative to the scan axis, X, and the print axis, Y). As shown in FIG. 5, it has been found that rotating away from this orthogonal orientation of the layout has distinct advantages. Moreover, note that the array also has each column of drop generators offset with respect to the Y-axis, arrow 119. (The purpose and methodology of such offsets is taught by Chan et al. in U.S. Pat. No. 4,812,859 for a *Multi-Chamber Ink Jet Recording Head for Color Use,* assigned to the assignee of the present invention and incorporated herein by reference.) A primary advantage is that such a configuration will allow bi-directional X-axis printing, doubling the effective throughput.

Figure 6A:
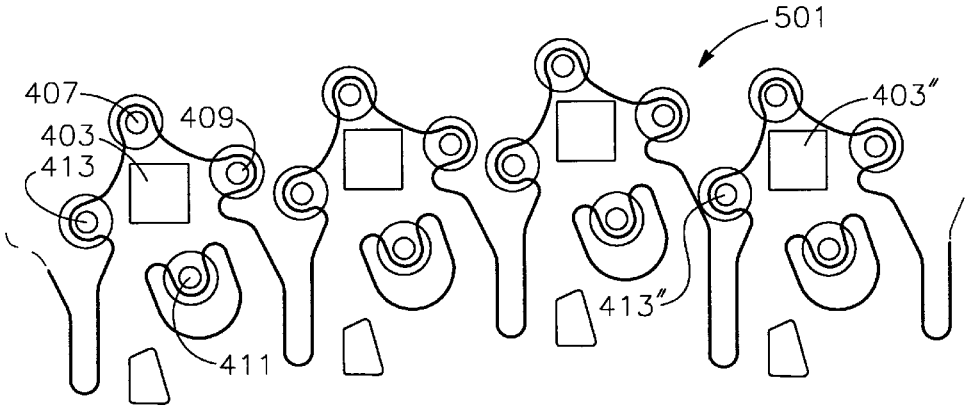
FIGS. 6A and 6B are schematic drawings (top view) of the embodiment of the present invention as shown in FIG. 5 shown in reduction in FIG. 6A and with FIG. 6B showing in comparison to FIG. 6A, a counter rotational orientation of the nozzle sets.
Figure 6B:
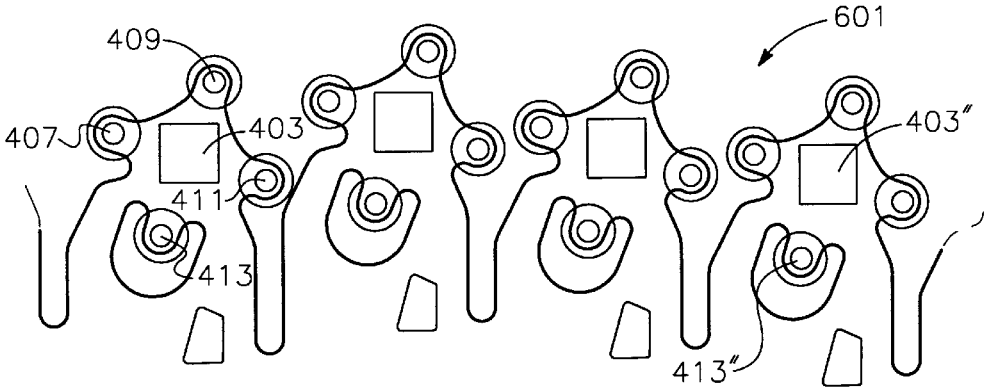

While FIGS. 5 and 6A show a right rotated quad architecture of the nozzles around the central heating element, FIG. 6B, demonstrates a left rotation of the nozzles 407–413" about the centrally located heating elements 403–403". As will be demonstrated hereinafter, it has been found that combinations of rotations and the use of different rotations affects print quality.

Figure 7:
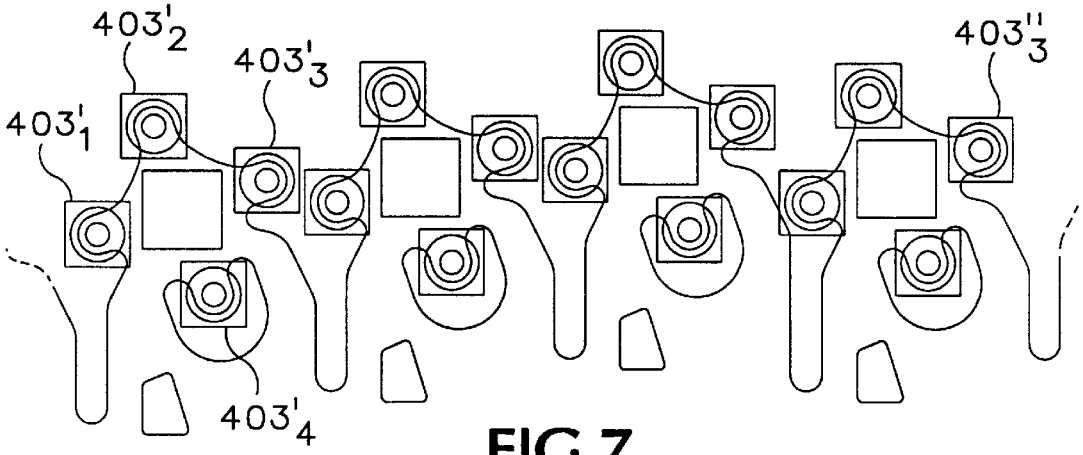
FIG. 7 is schematic drawing (top view) of a set of three, four nozzle, four heating element, ink-jet drop generators (a portion of a full array) in accordance with an alternative embodiment of the present invention as shown in FIG. 5.

FIG. 7 depicts an alternative embodiment where ink drop generators similar to FIG. 5 are employed with each nozzle 407–413" having a separate heating element $\mathbf{403'}_1$–$\mathbf{403'}_4$ through $\mathbf{403''}_4$. With this arrangement and using dot matrix manipulation, individual heating element electrical connections, and addressing algorithm techniques, it is possible to fire less than all nozzles at the same time. This would allow fine tuning of the image resolution.

Figure 8:
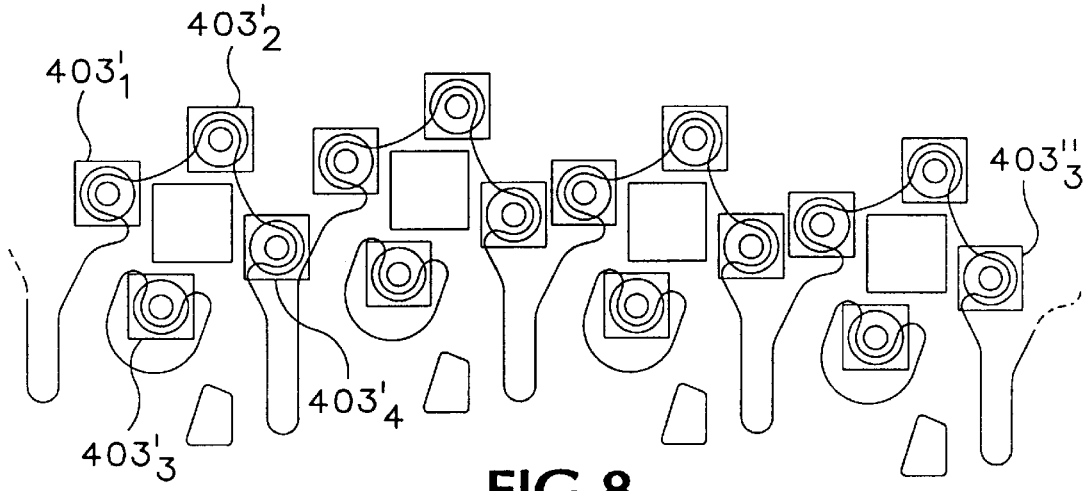
FIG. 8 is a schematic drawing (top view) of the embodiment of the present invention as shown in FIG. 7 with a counter rotational orientation of the nozzles.

While FIG. 7 shows a right rotation about a geometric center point of the drop generator indicative of the intersection of planes parallel to the X and Y axes, FIG. 8, demonstrates a left rotation of the nozzles 407–413" and the individual heating elements $\mathbf{403'}_1$–$\mathbf{403''}_3$.

Figure 9A:
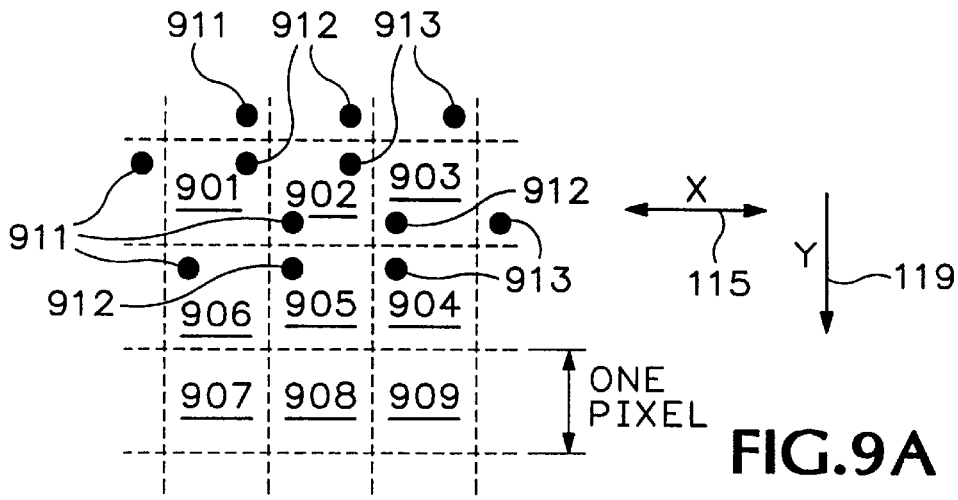
FIGS. 9A, 9B, and 9C demonstrate a method of sequential scanning passes for printing a dot matrix formed in accordance with the present invention using a single multi-nozzle drop generator as shown in FIG. 5.
Figure 9B:
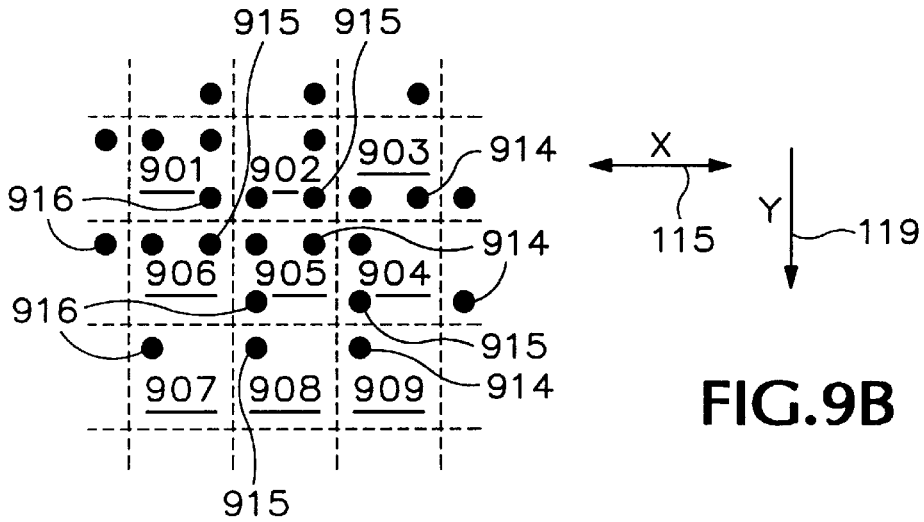
Figure 9C:
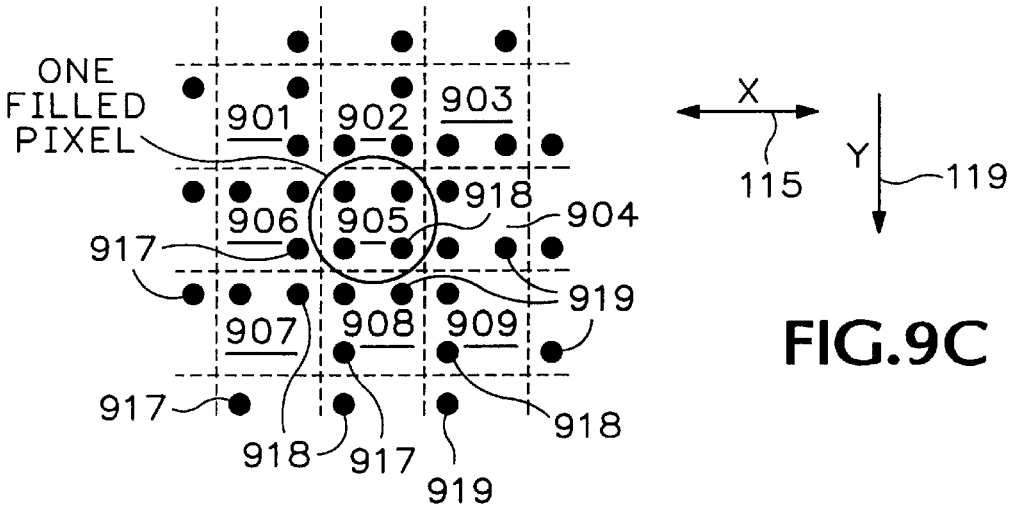

Printing operation in accordance with the present invention is depicted in FIGS. 9A–9C, showing a contiguous set of nine arbitrary pixels, 901–909, from a full grid overlay of an image to be printed (greatly magnified; in commercial designs each pixel generally will be $1/300''^2$ by $1/300''^2$ or smaller). For convenience of explanation, the firing of a single set of four nozzles as shown in FIG. 5 will be described in order to achieve a dot fill of more than one pixel 905; the process then continues sequentially. It should be understood that in a commercial embodiment, the firing will be algorithmically controlled and that some or all of the selected sets of nozzles in the array will fire four ink droplets of an appropriate color during each scan in the X-axis (arrow 115), creating a print head array wide swath equal to the length of the array in the Y-axis (arrow 119) in accordance with the firing signals generated by the print controller; for example, this could be a one inch or smaller pen swath up to a page length swath.

Assume a central pixel 905 of this grid subsection, having square dimensions of one three-hundredth of an inch ($1/300''$)$^2$, is to be covered with yellow ink. As shown in FIG. 9A, in the first scan pass, for example, left to right along the X-axis, "$\text{pass}_1$," four ink droplet 911 are fired in the Z-axis deposited about pixel 901 in accordance with instructions from the controller from one set of nozzles (e.g. nozzles 407", 409", 411", 413" as shown in FIG. 5). Note that at this firing, due to the rotated quad architecture, ink droplets 911 are deposited in pixels 902 and 906 and in two pixels outside the exemplary grid area 901–909. Upon movement of the print head $1/300''$ in the X axis 115 so that the nozzle set is traversing appropriately in a relative position with respect to pixel 902, four droplets 912 are deposited, including a first ink droplet in the upper left quadrant of the exemplary yellow pixel 905 and droplets in pixels 901 and 903. Upon moving the print head $1/300''$ so that the nozzle set is over pixel 903, four droplets 913 are deposited, including droplets in pixels 902 and 904. (In this example, only a single pixel row is being printed per pass; it will be recognized by a person skilled in the art that the complexity of the firing algorithm during $\text{pass}_1$ is dependent upon the image being produced and the full construction of the print head implementation with many pixels in a nozzle array wide swath are being inked simultaneously, including drop-on-drop mixing of primary color inks to produce all of the hues and luminance ratios of the image that are required to reproduce the image faithfully.) At the end of $\text{pass}_1$, with a media shift in the Y axis 119, a second swath can be printed during a next scan pass across the print medium.

FIG. 9B depicts a second pass, from right to left, $\text{pass}_2$, that first deposits four ink droplets 914 about pixel 904, including an ink droplet in the upper right quadrant of the target pixel and drops in pixels 903 and 909. Upon movement of the print head $1/300''$ so that the nozzle set is over the exemplary pixel 905, four droplets 915 are deposited, including droplets in the pixels 902, 904, 906 and 908. Upon moving the print head another $1/300''$ so that the nozzle set is over pixel 906, four droplets 916 are deposited, including a third ink droplet in the lower left quadrant of the exemplary pixel 905, and droplets in pixels 901 and 907.

Similarly, FIG. 9C depicts a third pass, from left to right, $\text{pass}_3$. Four ink droplets 917 are deposited about pixel 907, including dotting pixels 906 and 908 when the drop generator set is above pixel 907 in the Z axis (FIG. 1, arrow 117). Upon moving the print head $1/300''$ so that the nozzle set is over pixel 908, four droplets 918 are deposited, including a fourth ink droplet in the lower right quadrant of the exemplary pixel 905 and drops in pixels 907 and 909. Note that at this point in the $\text{pass}_3$, the region around exemplary pixel 905 is filled via this bidirectional scanning method. The process continues with drops 919 being deposited about pixel 909.

Also note that by $\text{pass}_3$, droplets of ink are being placed in locations such that some interlacing due to spreading may occur. This effect will depend upon the rotation layouts used in any specific design implementation.

It has been further discovered, that print quality is improved when a combination of different nozzle rotations orientation is used which also may be important for meeting mechanical tolerances during manufacture of the print head. For example, assume a CMYK ink-jet hard copy apparatus employs one tri-color print cartridge for CMY inks with subsets of the array of nozzles each coupled to specific color ink reservoir and a separate black ink print cartridge (e.g., a standard, single nozzle configuration). When the nozzle set array for cyan ink is left-rotated such as shown in FIG. 6B and the nozzle set arrays for magenta and yellow inks are respectively right rotated as shown in FIG. 5 and 6B, an improvement in print quality is achieved.

To demonstrate the achievement of improved print quality in accordance with the present invention, color samples of a facial image, eye region, are provided as FIGS. 10A–10D. These figures are a plain paper copy of a subsection prints and at a ten times magnification. The eye and a band of yellow makeup shown was each created from an original image by using four different computer generated virtual printing methodologies and the comparison prints made using a Hewlett-Packard™ DeskJet™ printer, model 850. FIG. 10A is a rendering of such a sample print as can be made with a conventional single nozzle print head, 300 dpi printer; FIG. 10B from a print made on a conventional single nozzle print head, 600 dpi printer; FIG. 10C from a print produced by experimental computer modeling using a print head in accordance with the present invention using a nozzle layout configuration for CMYK inks in a right rotated quad architecture ("CMYK R-RotQuad") as shown in FIG. 5; and, FIG. 10D from a print head in accordance with the present invention using nozzle array layout configuration for cyan ink in a left rotated orientation ("CL-") as shown in FIG. 6B and magenta and yellow inks nozzle array layout configurations in a right rotated architecture ("MYK-R-RotQuad") as shown in FIG. 5.

FIG. 10A shows a noticeable grain; that is, even in the highest resolution area of the iris, individual dots are very apparent to the unaided eye. Only in center of the pupil where black saturation is achieved do the individual dots disappear. Luminance transition regions, e.g., above the eye ball and to the viewer's right side where yellow dots are dominant, are discontinuous rather than smooth (compare FIG. 10B).

FIG. 10B shows a high resolution, 600 dpi, print with rich color saturation, smooth tonal transition, and markedly reduced granularity, with the reduced size individual dots showing quantization effects mostly in transition zones toning and the whites of the eyes.

Comparing FIG. 10C to FIGS. 10A and 10B, it can immediately be recognized that the overall print quality appears to be closer to the high resolution 600 dpi print of FIG. B than it does to FIG. 10A. A marked reduction in overall graininess obvious. Richer hues are perceived and luminance rations are improved.

Comparing FIG. 10D to FIGS. 10A and 10B, the same observations can be made as were made with respect to FIG. 10C. While FIGS. 10C and 10D are very close to each other in overall print quality, FIG. 10D has an overall sharpness that appears to be closer to FIG. 10B; in other words, the resolution appears to be slightly closer to the 600 dpi sample print.

The counter rotation of some color ink designated drop generators provides the advantage of more quantization effect print error reduction. As an example, note that FIG. 10D has less noticeable diagonal banding in the "white flash region" of the iris than does FIG. 10D. This technique also is effective at masking moire patterns (an undesirable pattern that occurs when a halftone is made from a previously printed halftone which causes a conflict between the dot arrangements).

Figure 11A:
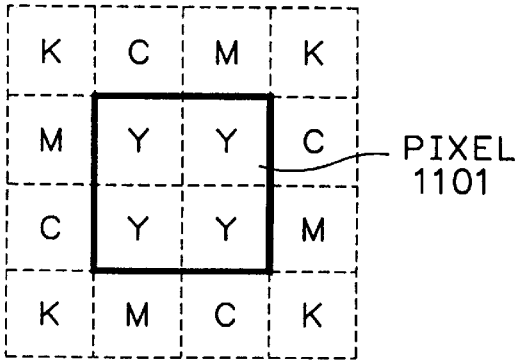
FIGS. 11A and 11B depict two exemplary print head nozzle orientation strategies for the methodology as shown in FIGS. 9A–9C.

An example of a specific advantageous printing scheme is shown in FIG. 11A. A combination of nozzle rotations in a print head is shown in order to direct four yellow droplets, represented by capital Y's in the drawing, toward accordance with a right rotated cyan nozzle cluster, represented by capital C's, a left rotated magenta nozzle cluster, represented by capital M's, and black placed at the outermost corners fired from a separate, conventional print head, i.e., a single nozzle design. This arrangement is desirable because it reduces granularity in the printed image.

Figure 11B:
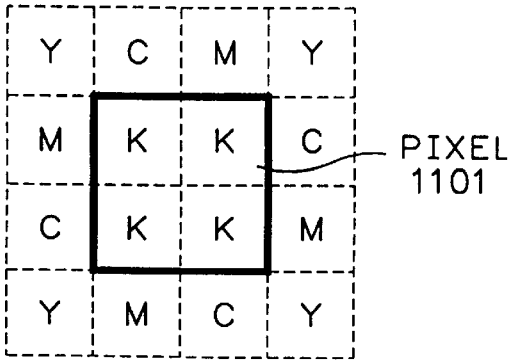

FIG. 11B indicates a rotation printing scheme which will enhance the printing of black dots, particularly, in a printer that will also be used for near-laser quality alphanumeric text printing.

Figure 12A:
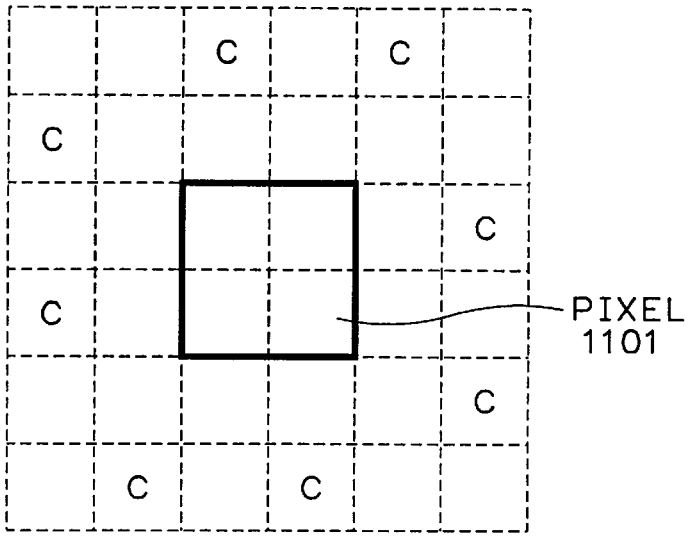
FIGS. 12A, 12B, 12C, 12D, and 12E demonstrate a more complex exemplary print head nozzle orientation strategy in comparison to FIGS. 11A–11B.
Figure 12B:
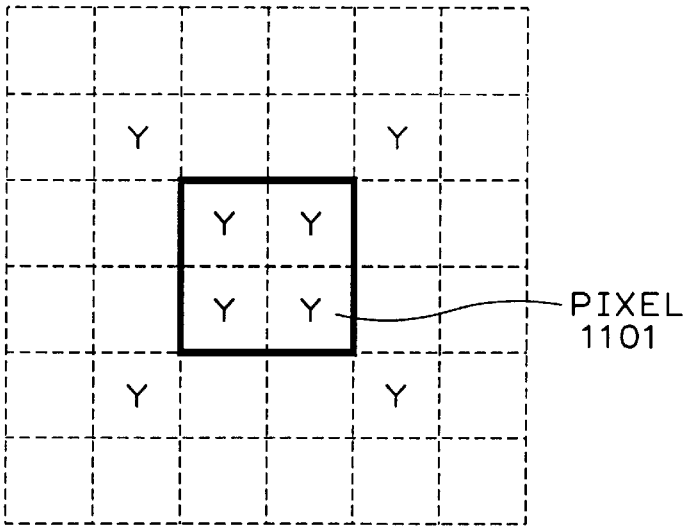
Figure 12C:
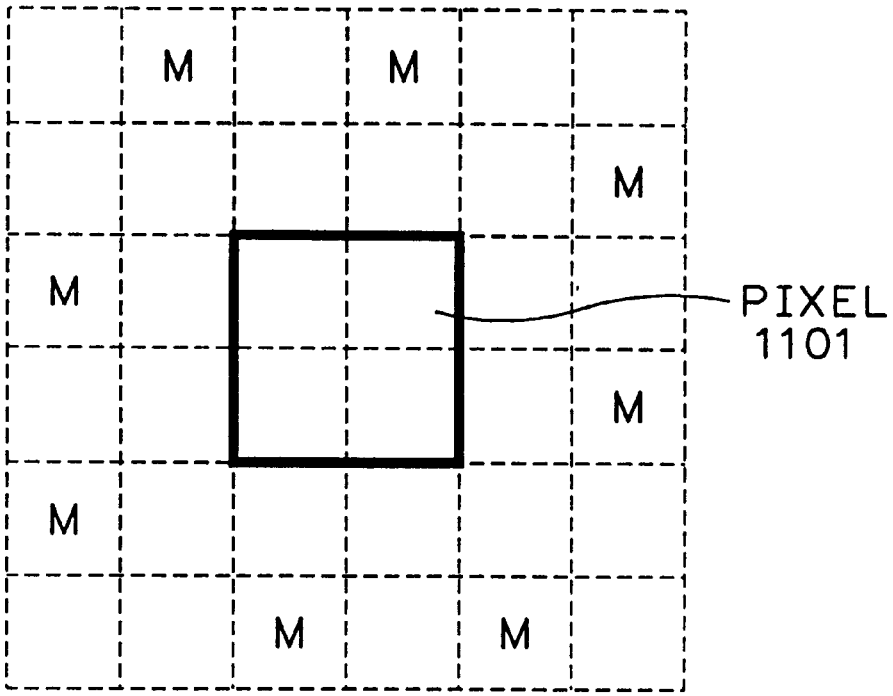
Figure 12D:
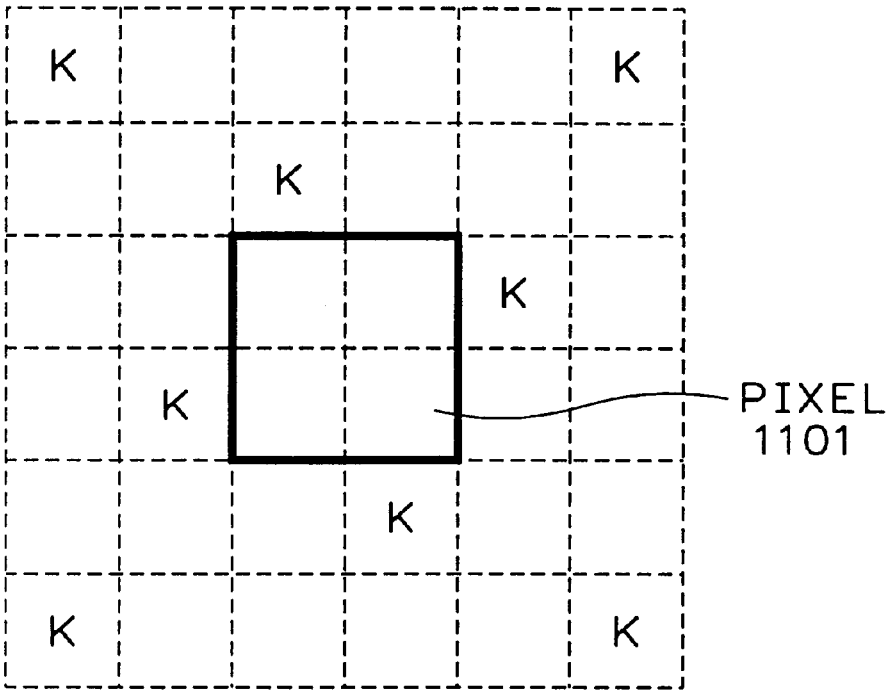
Figure 12E:
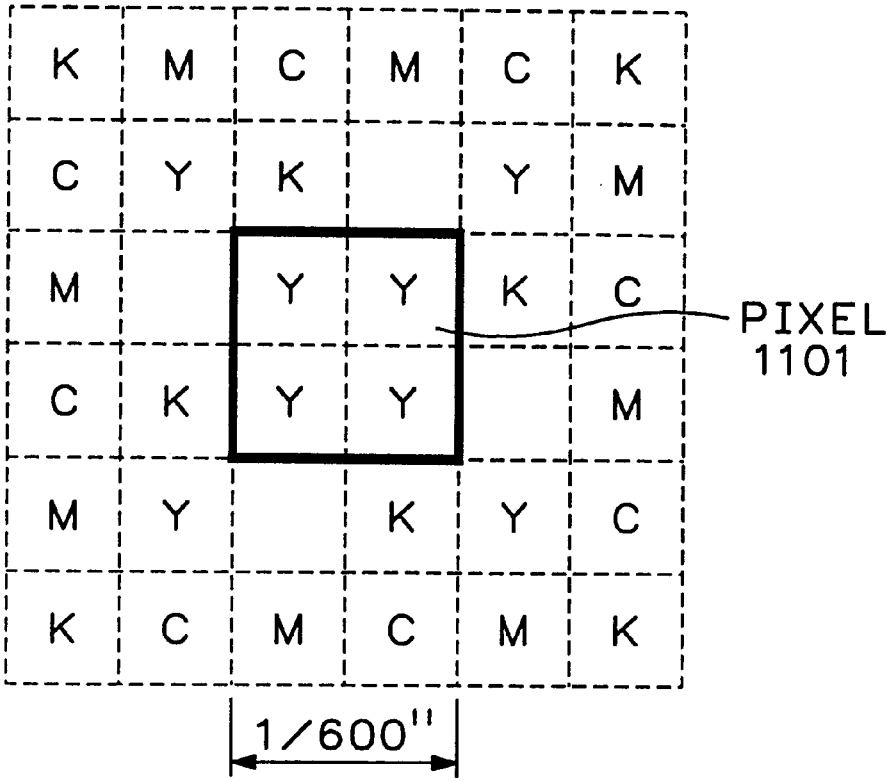

FIG. 12A through 12E demonstrate an example of the more complex implementation scheme which can be devised in accordance with the present invention. FIGS. 12A through 12D show that as scanned, an appropriately constructed print head can lay down super pixels in patterns such that as consecutive rows are printed, the super pixels are layered, C, Y, M, K to produce a pattern as shown in FIG. 12E. Actual nozzle firing and dot deposition will of course be based on the image being duplicated.

The present invention speeds throughput significantly due to the decreased nozzle size since refill time is proportional to the capillarity force which is inversely proportional to the radius of the bore of the nozzle. In the state of the art, a 300 dpi ink-jet printer operates at about five kHz, a 600 dpi printer operates at about twelve kHz. The deposition of the smaller droplets in accordance with the apparatus and method of the present invention (for example, having individual drop volumes equivalent to a 1200 dpi hard copy printer) is estimated to allow operating at approximately 30 kHz at 300 dpi but without the need for high data rates that multi-drop mode, high resolution printing requires.

The present invention also decreases print head operating temperature problems. Each heating element will fire more ink drops per cycle. The print head will tend to get hotter in conventional multi-drop modes in accordance with the formula:

$$T_e = E_{drop}/M_{drop} * C_p,$$

where $T_e$ represents the characteristic temperature change of the ink, firing, E is the drop energy, M is the drop mass, and $C_p$ is specific heat. It has been found that in high resolution printing, e.g., 1200 dpi, as the ink drops decrease in mass the energy requirement is not decreasing proportionally, leading to temperature excursions over 70° C. which is unacceptable for reproducible print.

In accordance with the foregoing description, the present invention provides a print head design and ink drop deposition methodology using that design which provides superior print quality while employing techniques generally associated with low resolution ink-jet printing. Print head mechanical and electrical operational requirements are also facilitated.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art.

Clearly, a set of nozzles per each drop generator is not limited to two, three or four. For example, where an ink composition is designed for lateral spreading, where the intent is to cover a region uniformly with as little ink as possible, a hexagonal array reduces the total ink deposited by approximately thirty percent. Thus, a combination of using some hexagonal sets of nozzles used for a black filled area with other configurations for other color inks can be designed into specific print heads.

Moreover, the present invention has been described in terms of a typical, commercial, scanning ink-jet apparatus. However, page width and page length print heads are also feasible in the state of the art and the invention is adaptable to those implementations.

Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. An ink-jet pen, comprising:

a housing;

at least one on-board ink reservoir within said housing, the reservoir containing at least one supply of ink of a predetermined chemical formulation;

a print head fluidically coupled to said reservoir to receive a flow of ink therefrom;

electrical contacts for electrically connecting said print head to a hard copy apparatus;

the print head having a plurality of drop generators oriented in an array;

at least one drop generator of the array having a plurality of nozzles arrayed about a geometric center point of the drop generator;

said at least one drop generator having at least one heating element connected to said electrical contacts;

each of said nozzles having an ink entrance port proximate said heating element, said entrance port having an entrance port areal dimension;

each of said nozzles having an exit orifice distal from the heating element for emitting ink droplets onto an adjacently positioned print medium, the exit orifice having a predetermined exit orifice areal dimension less than an areal dimension of a pixel to be printed and less than the entrance port areal dimension; and wherein each exit orifice has an exit orifice areal dimension less than or equal to an area calculated in accordance with a formula: the product of the dividend of 1 divided by the number of orifices per drop generator and the areal dimension of a pixel ($A_{eo} \leqq (1/n)*P_a$, where $A_{eo}$ is the exit orifice area, n is the number of orifices per drop generator and $P_a$ is the area of a pixel to be printed) such that the sum of the areal dimensions of the exit orifices in an array of nozzles is less than the areal dimension of a pixel.

2. The ink-jet pen as set forth in claim 1 further comprising:

the on-board ink reservoir is replenishable from an off-axis ink supply.

3. The ink-jet pen as set forth in claim 1 wherein said at least one drop generator further comprises:

a set of four nozzles; and a resultant dot area on a target medium of ink droplets from each of the four nozzles is less than or equal to one-half the larger of a length or width of a single pixel.

4. The ink-jet pen as set forth in claim 1 wherein each of said nozzles of each of said drop generators further comprises:

an exit orifice having an areal dimension that produces an ink droplet producing a dot on the target medium having a diameter less than or equal to one-half the larger of a length or width of a single pixel.

5. The ink-jet pen as set forth in claim 1 wherein said each of said exit orifices further comprises:

an exit orifice having a diameter producing an ink droplet forming a dot having a diameter approximately less than or equal to a diameter in a range of approximately twenty to twenty-five microns.

6. The ink-jet pen as set forth in claim 1 wherein the print head further comprises:

each of the nozzles of said at least one of said drop generators being oriented in a position about a center point of said at least one drop generator with respect to an intersection of axes in a plane of a scan axis and a plane of a media motion axis.

7. The ink-jet pen as set forth in claim 6 wherein the print head further comprises:

each of the nozzles of said at least one drop generator being oriented in a position rotated about the center point such that dots are printed from each of said nozzles at least partially in adjoining pixels to a pixel which a drop generator is traversing.

8. The ink-jet pen as set forth in claim 6 wherein the print head further comprises:

in the array of drop generators, said set of nozzles for said at least one drop generator being associated with a first color of ink and oriented in said position about the center point and a set of nozzles for a second drop generator of said array of drop generators being associated with a second color of ink and positioned in a rotated orientation about the center point.

9. The ink-jet pen as set forth in claim 6 wherein the print head further comprises:

said nozzles of said at least one drop generator being positioned in a non-symmetrical distribution about the center point.

10. The ink-jet pen as set forth in claim 6 wherein said print head further comprises:

said array of drop generators having fewer than all of the drop generators having their respective nozzles positioned in an identical geometrically symmetrical pattern about respective center points of each of said drop generators.

11. The ink-jet pen as set forth in claim 1 wherein the print head further comprises:

each drop generator in the array having a plurality of heating elements.

12. The ink-jet pen as set forth in claim 1 wherein the print head further comprises:

each of the nozzles of each of the drop generators having a separate heating element positioned subjacent the entrance diameter.

13. The ink-jet pen as set forth in claim 1 further comprising:

a volume of ink ejected in ink droplets from a set of nozzles of a single drop generator being less than a volume of a single droplet of ink required to completely cover a square pixel with a round dot.

14. The ink-jet pen as set forth in claim 1 further comprising at least one of said nozzles of a drop generator disposed to place a dot on said print medium in a location essentially outside of said pixel.

15. The ink jet pen as set forth in claim 1 further comprising each of said nozzles having said exit orifice being sized for ejecting an ink droplet that produces a dot on said target medium having an area less than or equal to the product of the dividend of 1 divided by the number of dots created per drop generator and the area of a target pixel ($area_{dot} \leqq (1/n)*P_a$, where "n" is the number of nozzles per drop generator producing a dot and "$P_a$" is the area of said target).

16. A method of distributing ink dots onto an adjacent print medium in order to form a dot matrix print on a grid of pixels wherein the dot matrix is manipulated selectively to form graphic art, images, and alphanumeric characters, the method comprising the steps of:

scanning a print medium with at least one ink-jet pen in a first axial direction, X;

during said step of scanning, simultaneously generating a plurality of ink droplets in each drop generator of a drop generator array of an ink-jet print head of the ink-jet pen, simultaneously firing sets of the simultaneously generated ink droplets selectively at the grid of pixels such that each of the sets of ink droplets form dots on the print medium, each of said dots having a size less than the size of a pixel, and each of the sets of ink droplets being distributed in a pattern on or about a target pixel of said grid such that each of the droplets of a set produces a dot having an area less than or equal to the product of the dividend of 1 divided by number-of-drops-per-set and the area of the target pixel $(\text{area}_{dot} \leqq (1/n)*P_a,$ where n is the number of orifices per drop generator producing a dot and $P_a$, is the area of a pixel to be printed).

17. The method as set forth in claim 16 further comprising the steps of:

in said step of simultaneously firing sets of the simultaneously generated ink droplets, producing dots on the media having a diameter approximately less than or equal to a diameter in a range of approximately twenty to twenty-five microns.

18. The method as set forth in claim 16 further comprising the steps of:

scanning a print medium with at least one ink-jet pen in a second axial direction, -X, opposite the first axial direction, and repeating said steps of simultaneously generating and simultaneously firing ink droplets onto said print medium.

19. The method as set forth in claim 16 wherein the step of simultaneously firing ink drops further comprises:

firing a plurality of ink drops from a nozzle set of a drop generator wherein the combined areal coverage of a plurality of dots resulting from the plurality of ink drops is less than or equal to a pixel area but said plurality of dots is distributed on the print medium over an area greater than said pixel area.

20. The method as set forth in claim 16 wherein said step of simultaneously firing sets of the simultaneously generated ink droplets further comprises the step of:

directing said simultaneously fired ink droplets away from each other whereby said ink droplets diverge in flight from the print head to the medium.

21. An ink-jet hard copy apparatus, having a housing, a scanning carriage, an electronic controller, at least one pen mounted in the carriage, and a platen where swath printing operation is performed, said apparatus comprising:

said pen having a housing;

at least one on-board ink reservoir within said housing, the reservoir containing at least one supply of ink of a predetermined chemical formulation;

a print head fluidically coupled to said reservoir to receive a flow of ink therefrom;

electrical contacts for connecting said print head to the hard copy apparatus electronic controller;

the print head having a plurality of drop generators oriented in an array;

at least one of said plurality of drop generators of the array having a plurality of nozzles arrayed about a geometric center point of the drop generator;

said at least one drop generators having at least one coordinated heating element connected to said electrical contacts; and each of said nozzles having an ink entrance port proximate said heating element, said entrance port having an entrance port areal dimension, each of said nozzles having an exit orifice distal from the heating element for emitting ink drops onto an adjacently positioned print medium, the exit orifice having a predetermined exit orifice areal dimension producing an ink droplet that forms a dot on an adjacent print medium such that said dot has an areal dimension less than the areal dimension of a pixel to be printed using said cartridge and wherein the sum of the areal dimensions of the dots produced from said plurality of nozzles is less than or equal to the areal dimension of a pixel, and each of the nozzles of said at least one drop generator being oriented in a position rotated about a geometric center point of the drop generator with respect to an intersection of axes in a plane of a scan axis and a plane of a media motion axis such that dots are printed from each of said nozzles in adjoining pixels to a pixel which a drop generator is traversing, and each exit orifice having an exit orifice areal dimension less than or equal to an area calculated in accordance with a formula:

$(A_{eo} \leqq (1/n)*P_a$, where $A_{eo}$ is the exit orifice area, n is the number of orifice per drop generator, and $P_a$ is the area of a pixel to be printed).

22. The apparatus as set forth in claim 21, further comprising:

said drop generators are divided into sets of a print head array, each of the drop generators in said sets having a plurality of nozzles where at least one set has a different number of nozzles than the other sets.

23. The ink-jet hard copy apparatus as set forth in claim 21 further comprising each of said nozzles having said exit orifice areal dimension being sized for ejecting an ink droplet that produces a dot on said target medium having an area less than or equal to the product of the dividend of 1 divided by the number of dots created per drop generator and the area of a target pixel ($\text{area}_{dot} \leqq (1/n)*P_a$, where "n" is the number of nozzles per drop generator producing a dot and "$P_a$" is the area of said target).

24. The apparatus as set forth in claim 21 further comprising at least one of said nozzles of a drop generator disposed to place a dot on said print medium in a location essentially outside of said pixel.

25. A printhead device for use in a printer printing ink dots arranged in pixels of predetermined size on a print medium, comprising:

an array of drop generators;

a plurality of nozzles associated with one of said array of drop generators to essentially simultaneously eject an ink droplet from each of said plurality of nozzles and each of said plurality of nozzles sized to create a dot on the print medium, each said dot having an area less than or equal to the product of the dividend of 1 divided by the number of dots created per drop generator and the area of a target pixel ($\text{area}_{dot} \leqq (1/n)*P_a$, where n is the number of nozzles per drop generator producing a dot and $P_a$ is the area of said target pixel);

wherein said plurality of nozzles are arranged in said printhead device to distribute each said dot from each one of said plurality of nozzles about said target pixel.

26. The printhead device as set forth in claim 25 wherein said plurality of nozzles are arranged in said printhead device to provide a distribution of dots on the print medium that are at least partially outside said target pixel area.

27. The printhead device as set forth in claim 25 wherein said plurality of nozzles are arranged in said printhead device such that any adjacent nozzles of said plurality of nozzles do not lie in a line parallel to a scan axis of the printer such that dots are printed from said plurality of nozzles at least partially in a pixel adjoining said target pixel.

28. The printhead as set forth in claim 25 wherein said plurality of nozzles are arranged in said printhead device such that each nozzle of said plurality of nozzles is oriented in a position about a center point of said one of said drop generators with respect to an intersection of axes in a plane of a scan axis and a plane of motion of the print medium.

29. The printhead as set forth in claim 28 wherein said plurality of nozzles are arranged in said printhead device such that each nozzle of said plurality of nozzles is oriented in a position rotated about a center point of said one of said drop generators with respect to an intersection of axes in a plane of a scan axis and a plane of motion of the print medium such that dots are printed from each of said nozzles at least partially in a pixel adjoining said target pixel.

30. The printhead device as set forth in claim 28 further comprising a second plurality of nozzles associated with a second of said drop generators, said second plurality of nozzles arranged in said printhead device such that each nozzle of said second plurality of nozzles is oriented in a position rotated about a center point of said second of said drop generators with respect to an intersection of axes in a plane of a scan axis and a plane of motion of the print medium such that dots are printed from said second plurality of nozzles at least partially in a pixel adjoining a pixel which said second of said drop generators is traversing.

31. The printhead device as set forth in claim 25 wherein each nozzle of said plurality of nozzles is sized to produce an ink droplet on said target medium having a diameter less than or equal to one-half the larger of a length or width of a single pixel.

32. An ink-jet pen, comprising:

a housing;

at least one on-board ink reservoir within said housing, the reservoir containing at least one supply of ink of a predetermined chemical formulation;

a print head fluidically coupled to said reservoir to receive a flow of ink therefrom;

electrical contacts for electrically connecting said print head to a hard copy apparatus;

the print head having a plurality of drop generators oriented in an array;

each drop generator of the array having a plurality of nozzles arrayed about a geometric center point of the drop generator;

each of said drop generators having at least one heating element connected to said electrical contacts;

each of said nozzles of at least one of said drop generators having an ink entrance port proximate said heating element;

each of said nozzles of said at least one drop generator having an exit orifice distal from the heating element for ejecting ink droplets toward an adjacently positioned print medium, wherein as said at least one drop generator traverses a target pixel of said print medium each of said nozzles ejects an ink droplet creating a dot on a target medium with an area less than or equal to the product of the dividend of 1 divided by the number of drops per set and the area of said target pixel ($area_{dot} \leqq (1/n)*P_a$, where n is the number of orifices per drop generator producing a dot and $P_a$ is the area of said target pixel) and wherein the sum of the areal dimensions of all dots created by each of said nozzles is less than or equal to the areal dimension of said target pixel.

33. The ink-jet pen as set forth in claim 32 further comprising said on-board ink reservoir being replenishable from an off-axis ink supply.

34. The ink-jet pen as set forth in claim 32 wherein the print head further comprises:

each of the nozzles of said at least one of said drop generators being oriented in a position about a center point of said at least one drop generator with respect to an intersection of axes in a plane of a scan axis and a plane of a media motion axis.

35. The ink-jet pen as set forth in claim 34 wherein the print head further comprises:

each of the nozzles of said at least one drop generator being orientated in a position rotated about the center point such that dots are printed from each of said nozzles at least partially in adjoining pixels to a pixel which a drop generator is traversing.

36. The ink-jet pen as set forth in claim 34 wherein the print head further comprises:

in the array of drop generators, said set of nozzles for said at least one drop generator being associated with a first color of ink and oriented in said position about the center point and a set of nozzles for a second drop generator of said array of drop generators being associated with a second color of ink and positioned in a rotated orientation about the center point.

37. The ink-jet pen as set forth in claim 34 wherein the print head further comprises:

said nozzles of said at least one drop generator being positioned in a non-symmetrical distribution about the center point.

38. The ink-jet pen as set forth in claim 34 wherein said print head further comprises:

said array of drop generators having fewer than all of the drop generators having their respective nozzles positioned in an identical geometrically symmetrical pattern about respective center points of each of said drop generators.

* * * * *